US006088985A

United States Patent [19]

Clark

[11] Patent Number: 6,088,985

[45] Date of Patent: Jul. 18, 2000

[54] STRUCTURAL TIE SHEAR CONNECTOR FOR CONCRETE AND INSULATION SANDWICH WALLS

[75] Inventor: Timothy L. Clark, Lithonia, Ga.

[73] Assignee: Delta-Tie, Inc., Ames, Iowa

[21] Appl. No.: 09/374,789

[22] Filed: Aug. 16, 1999

Related U.S. Application Data

[62] Division of application No. 08/997,908, Dec. 24, 1998.

[51] Int. Cl.[7] ..... E04C 2/288

[52] U.S. Cl. ..... 52/309.11; 52/309.12

[58] Field of Search ..... 52/309.9, 309.11, 52/309.12, 309.14, 309.17, 426, 565, 568

[56] References Cited

U.S. PATENT DOCUMENTS

| | | | |
|---|---|---|---|
| 3,179,983 | 4/1965 | Webber et al. . | |
| 3,237,357 | 3/1966 | Hutchings . | |
| 3,305,991 | 2/1967 | Weismann . | |
| 3,494,088 | 2/1970 | Korner . | |
| 3,750,355 | 8/1973 | Blum . | |
| 3,879,908 | 4/1975 | Weismann . | |
| 4,079,560 | 3/1978 | Weismann . | |
| 4,104,842 | 8/1978 | Rockstead et al. . | |
| 4,117,639 | 10/1978 | Steenson et al. . | |
| 4,226,067 | 10/1980 | Artzer . | |
| 4,268,574 | 5/1981 | Peccinini et al. | 52/309.11 |
| 4,283,896 | 8/1981 | Fricker et al. . | |
| 4,346,541 | 8/1982 | Schmitt . | |
| 4,505,019 | 3/1985 | Deinzer . | |
| 4,611,450 | 9/1986 | Chen . | |
| 4,640,074 | 2/1987 | Paakkinen . | |
| 4,768,324 | 9/1988 | Hibbard . | |
| 4,829,733 | 5/1989 | Long . | |
| 4,866,891 | 9/1989 | Young | 52/309.12 |
| 4,884,382 | 12/1989 | Horobin | 52/309.12 |
| 4,974,381 | 12/1990 | Marks . | |
| 5,058,345 | 10/1991 | Martinez . | |
| 5,440,845 | 8/1995 | Tadros et al. . | |
| 5,611,183 | 3/1997 | Kim | 52/426 |
| 5,709,060 | 1/1998 | Vaughan et al. | 52/426 |

*Primary Examiner*—Michael Safavi

*Attorney, Agent, or Firm*—Zarley, McKee, Thomte, Voorhees & Sease

[57] ABSTRACT

A structural tie shear connector utilized in a concrete and insulation sandwich wall panel having first and second wythes and an insulation layer interposed therebetween. The connector includes first and second horizontal strands of thermally non-conductive material which are adapted to be encased by the respective wythes. A transverse web of thermally non-conductive material interconnects the first and second strands through the insulation layer. The web includes strands formed into a lattice structure. At least one of the strands of the lattice extends at an angle with respect to one of the first and second strands so as to be in tension when a load is applied to the wall panel. The connector resembles a bow tie. The method of making sandwich wall panels disclosed herein includes pouring the first layer of concrete into a form; laying a plurality of insulation strips adjacent each other to define at least one gap therebetween; providing a bow tie shear connector having a chairing loop portion thereon; while the first layer of concrete is still plastic, inserting the connector through the gap and into the first layer of concrete such that the chairing loop portion rests on the bottom of the form; and pouring a second layer of wet concrete onto the insulation strips in the form. The chairing loop positively locates the connector with respect to the form, the concrete layers and the insulation layer without being affixed to the insulation.

13 Claims, 3 Drawing Sheets

STRUCTURAL TIE SHEAR CONNECTOR FOR CONCRETE AND INSULATION SANDWICH WALLS

CROSS REFERENCE TO RELATED APPLICATION(S)

This application is a divisional of co-pending application Ser. No. 08/997,908 filed Dec. 24, 1998.

BACKGROUND OF THE INVENTION

The present invention relates to the field of precast concrete insulated sandwich panels in which the exterior wythes of concrete sandwich a singular interior wythe of insulation. The tie shear connection of this invention functions to connect the two concrete wythes structurally so as to form a singular structural wall panel that acts as a composite singular wall element. The invention transfers loads (such as wind) imposed onto one concrete wythe across the insulation layer and into the opposite concrete wythe. These two concrete wythes act in concert (composite action) to provide a singular load-resisting element greater than the sum capacities of the individual wythes.

An insulated sandwich panel is composed of two layers (wythes) of concrete separated by a high density foam insulation in the center. The thickness of the concrete layers varies depending upon the structural requirements of the building. The most common load requirements include wind load, roof load, and seismic load. These loads must be collected and then transferred to the building frame and the building foundation. The two concrete wythes handle the majority of this work in concert. But, when the concrete layers are separated by an insulation layer, a structural tie must be used to connect the two concrete wythes together across the insulation layer in such a manner as to cause the two concrete wythes to function more as a single composite unit structurally. However, conventional ties allow thermal bridging, or a loss of heating/cooling energy via the structural tie.

There is an initial bond between the concrete and insulation, but this bond is eventually broken due to handling, temperature differentials and cycling, or service loads, it is necessary to provide shear connectors to transfer forces between the wythes due to longitudinal bending of a panel. These connectors have sufficient strength and stiffness to allow a significant level of interaction between the wythes in the resistance of loads. Non-shear connectors are not designed to transfer longitudinal shear forces between the wythes and primarily serve as a means to hold the various layers together. Traditionally, steel inserts or solid concrete penetrations through the insulating layer have been the primary means of shear connection. These connectors, however, result in thermal short-circuits across the insulation layer and decrease the thermal efficiency of the panel. Steel inserts can also lead to unsightly oxidation or rust on the panel faces.

In an effort to eliminate the problem of thermal bridging, the use of fiber reinforced plastic (FRP) materials in the fabrication of wythe connectors, such as dowel pin connectors and bent bar connectors, was started. With a thermal conductivity approximately 1/100 that of stainless steel, FRP material is seen as an excellent replacement for steel or concrete as wythe connectors. However, FRP dowel pin connectors are inserted normal to the layers. Thus, they have glass fibers subjected to bending during loading of the sandwich panel. The load capacity of the pins is resin-dependent. Many more pins are typically required to replace a few steel trusses.

Therefore, a primary objective of the present invention is the provision of an improved structural shear tie connector.

A further objective of this invention is the provision of an essentially thermally non-conductive (non-metallic) shear tie connector having transverse webs wherein the angled members are in tension under loading conditions.

A further objective of this invention is the provision of a tie connector that is strong, compact, economical to manufacture, and easy to install.

These and other objectives will become apparent from the drawings, as well as from the description and claims which follow.

SUMMARY OF THE INVENTION

The present invention relates to concrete and insulation sandwich wall panels having first and second layers or wythes and an insulation layer interposed therebetween. Disclosed herein is a structural shear tie connector, which includes first and second spaced horizontal strands of thermally non-conductive material. The first and second strands are adapted to be encased respectively by the first and second concrete wythes. A web of thermally non-conductive material interconnects the first and second strands through the insulation layer and forms at least one loop. At least one of the strands of the loop extends at an angle with respect to one of the first and second strands such that the angled strand is in tension when a load is applied to the sandwich wall panel.

Preferably the strands are formed of fiberglass reinforced plastic and are formed as a continuous unwelded structure. The first and second strands of the connector are preferably substantially parallel to each other so that the strands and the intersection of the web thereto are wholly disposed in the respective concrete layer.

The web has a anchoring loop portion which extends outwardly beyond one of the first or second horizontal strands. Concrete is allowed to fill the loop portion in the concrete layer, thus anchoring the connector. This loop also positively locates, gauges, "chairs" or spaces the tie with respect to the bottom face of the form and consequently to the bottom surface of one of the concrete layers.

A method of forming sandwich wall panels with such tie connectors is also disclosed.

DETAILED DESCRIPTION OF THE PREFERRED EMBODIMENT

Figure 2:
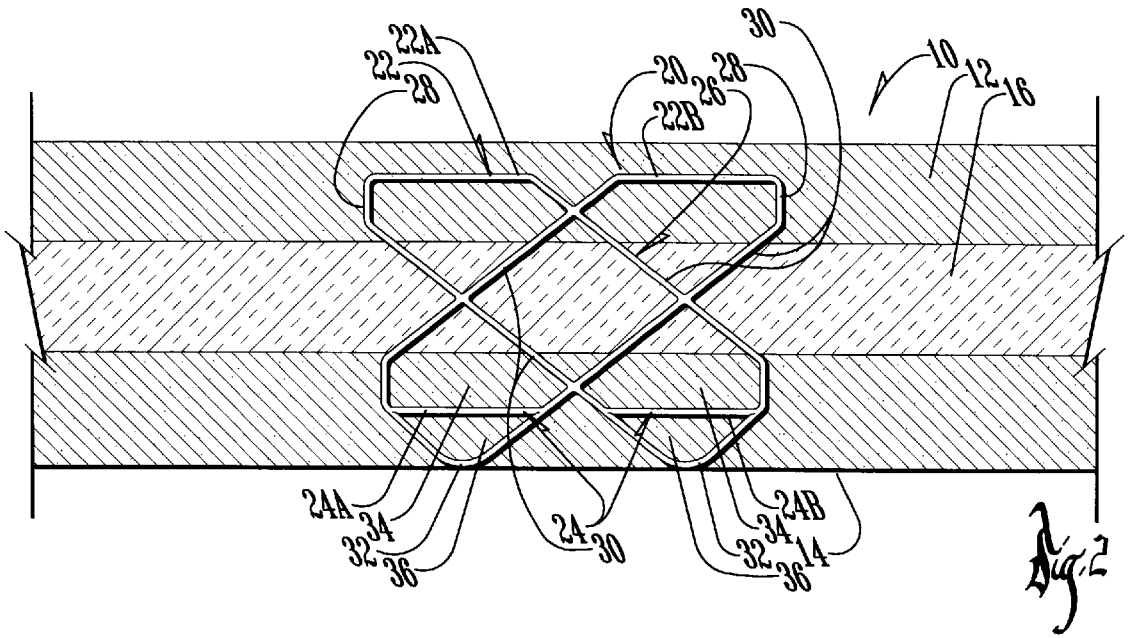
FIG. 2 is a partial sectional view showing the bow tie connector of the present invention.

In the drawings and the description which follows, like features are denoted with like reference numerals.

Figure 1:
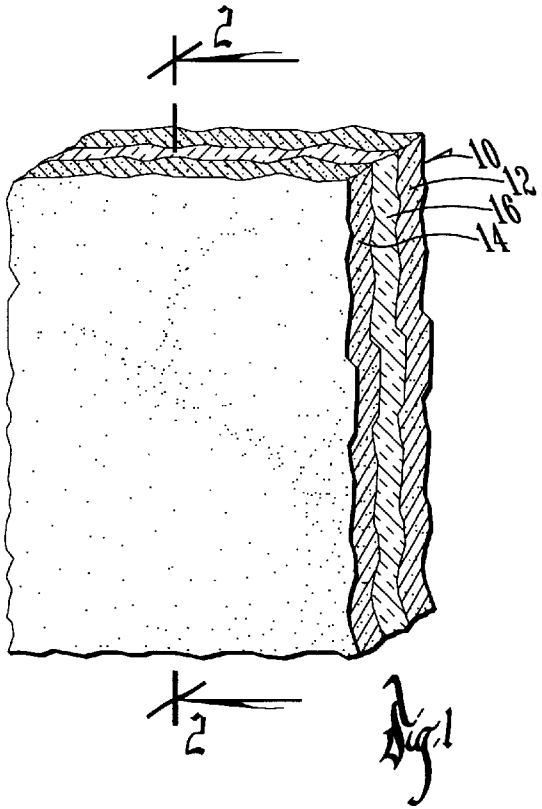
FIG. 1 is a perspective view of a concrete and insulation sandwich wall panel having the tie connectors of the present invention.
Figure 3:
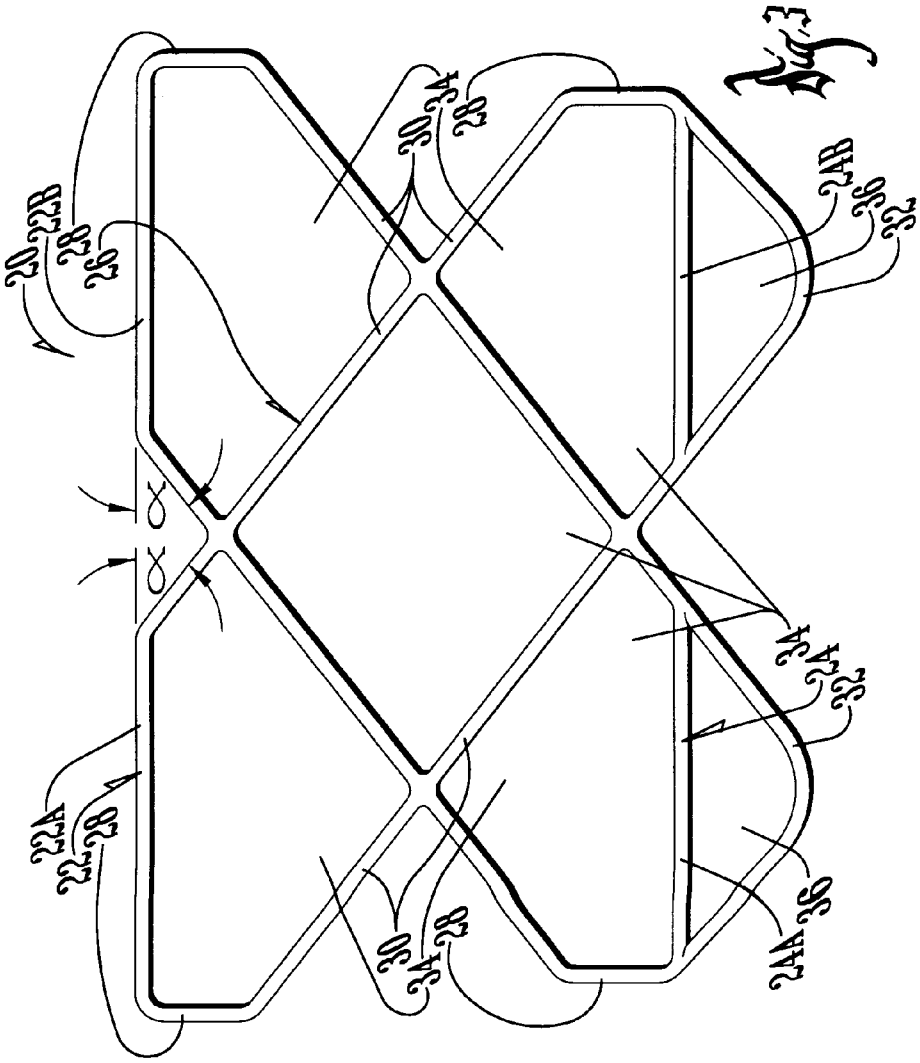
FIG. 3 is a front elevation view of the bow tie connector of this invention.

A concrete and insulation sandwich (wall) panel appears in FIG. 1. As best seen in FIGS. 2 and 3, the panel 10 includes first and second concrete wythes (layers) 12, 14 and an insulation layer 16 interposed therebetween. The insulation layer 16 includes a high density polystyrene foam insulation or similar material having high thermal resistance. The panel 10 is preferably precast and is frequently used to provide an insulated outer shell to buildings. However, the panel can also be formed on the site where the building is being erected.

FIG. 2 illustrates the preferred embodiment of the present invention, wherein a tie shear connector in the form of a compact double looped "bow tie" shear connector is provided. The term bow tie is used because this configuration resembles the similarly named clothing accessory. The bow tie connector 20 extends through the insulation layer 16. The bow tie design is more compact than conventional truss style designs.

The bow tie 20 includes a first horizontal strand 22 spaced apart from a second horizontal strand 24. Preferably the horizontal strands 22, 24 are parallel and near the top and bottom of the shear tie connector, respectively. The strand 22 or 24 need not be a single straight member. A gap can exist between left and right portions 22A, 22B, 24A, 24B of the respective strands 22, 24. In fact, such a gap is useful in accommodating other reinforcing structures in the concrete layers, such as rebar or prestressed strands. Thus, the gap can even be used to position the bow tie 20.

The horizontal strands 22, 24 should reside in the concrete layers 12, 14 respectively. When installed in the panel 10, the first strand 22 remains above the insulation layer 16 and the second strand 24 remains below the insulation layer 16. When the concrete is poured to form the panel 10, the first strand 22 is encased by the first concrete wythe 12 and the second strand 24 is encased by the second concrete wythe 14. The first and second strands 22, 24 will also be referred to herein as the top and bottom strands or cords respectively. However, the bow tie shear connector can be rotated or inverted if the expected load or placement conditions dictate.

A web 26 is continuously formed with the strands 22, 24 in the concrete layers 12, 14. The web 26 includes substantially vertical legs 28 which extend inwardly from the strands 22, 24 toward the insulation layer 16 (see FIG. 2). The web 26 includes the legs 28 and angled members 30 which extend at an angle $\alpha$ with respect to the first and second horizontal strands 22, 24.

The strands 22, 24 and the web 26, including the angled members 30 and legs 28 are preferably formed of a thermally non-conductive material, such as fiberglass reinforced vinyl-ester (FRP). The material is non-metallic in order to have the desired thermal properties. The strands of the web 26 are preferably continuously formed so that no welding is required and no thermal bridge is provided between the concrete layers 12, 14.

The strands 22, 24, 28, 30 and 32 are continuous and are integrally formed by a conventional winding process. The strands of fiberglass are wound around a mandrel and impregnated with ester resins to form a continuous roving. The web 26 can be formed of a left-angled loop and a right-angled loop which are then glued together with resin, but preferably the loops are wound together on the same mandrel.

Referring to FIG. 3, the angle $\alpha$ is preferably approximately 30° to 60°, more preferably 50°. The strands 22, 24 and the transverse web 26 lie in a common plane. Chairing loop portions 32 extend below the second horizontal strand 24. Non-chairing loops could also be formed so as to extend above the first horizontal strand 22. Interstitial spaces 34 are formed between the strands 22, 24, 28, 30 and 32.

The chairing loop portions 32 can occur at almost any frequency, as desired. One purpose of the chairing loop portions 32 is to allow a concrete bar to be formed between the loop portion 32 and the horizontal strand 22 or 24. This provides additional strength and rigidity to the sandwich panel 10 and helps anchor the tie connector 20 in place.

Figure 4:
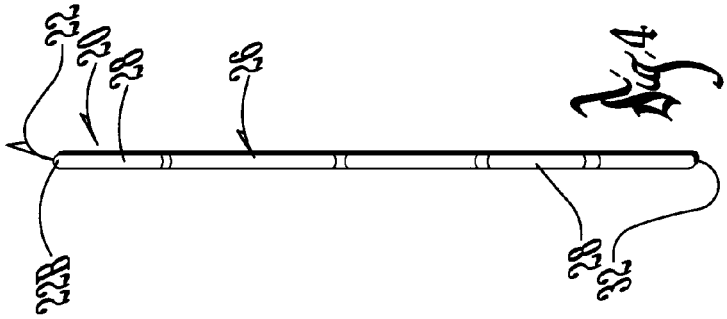
FIG. 4 is a side elevation view of the bow tie connector of FIG. 3.

The bow tie shear connector 20 is relatively small sturdy, and compact. A plurality of bow tie connectors 20 can be placed in the sandwich panel 10 to meet the load requirements. Referring to FIG. 4, the thickness or effective diameter of the strands 22, 24, 28, 30, 32 is preferably approximately 3/16". However, the required thickness or cross sectional area can be calculated based upon the load conditions which are expected to be encountered. Thus, the invention is not restricted to strands of this thickness. In this embodiment, the bow tie connector 20 is approximately 7½" long and 5¼" high. However, other dimensional combinations are possible due to the flexibility of this invention.

Advantageously, the angled members 30 of the bow tie connector 20 resolve the bending stresses into linear stresses having vertical and horizontal components. The angled members 30 are in tension when a load is applied to the sandwich wall panel 10. The bow tie is functionally complete when it forms two crossing main loops. One main loop includes two angled members 30 extending to the right from bottom to top and interconnected by horizontal strands 22, 24. The other main loop includes two angled members 30 extending to the left from bottom to top and interconnected by horizontal strands 22, 24. However, additional loops, strands, and angled members 30 can be added as desired.

The angled members 30 resolve the bending stresses placed on the wall panel 10 into linear stresses which are transferable between the wythes 12, 14 so as to form a fully composite panel. Since the strands have negligible thermal conductivity and are non-metallic, no thermal bridging occurs between the wythes 12, 14. Oxidation or rust will not occur on the faces of the panel 10. The tie connector of this invention resolves the loads into a horizontal component and a vertical component. For the purposes of this discussion, the vertical component is normal (90°) to the plane of the wythes 12, 14. The horizontal component is parallel to the plane of the wythes 12, 14. For the wall panel 10 to resist wind, roof, and seismic loads, the horizontal component is the larger component by a great magnitude. The angled web members 30 of the tie connector handle this high load component in tension, which takes full advantage of the tensile strength of the glass fibers.

The tie connector transfers loads without depending upon the resin matrix between the glass fibers. The resin matrix is merely a facilitating medium to position the glass while the insulated precast panel is being manufactured. The fiberglass has a coefficient of thermal expansion nearly the same as concrete. This is extremely important in that thermal stresses between two incompatible mediums would and could exceed the mechanical load stress limits. Furthermore, the thermal conductivity of glass is very close to zero.

Figure 5:
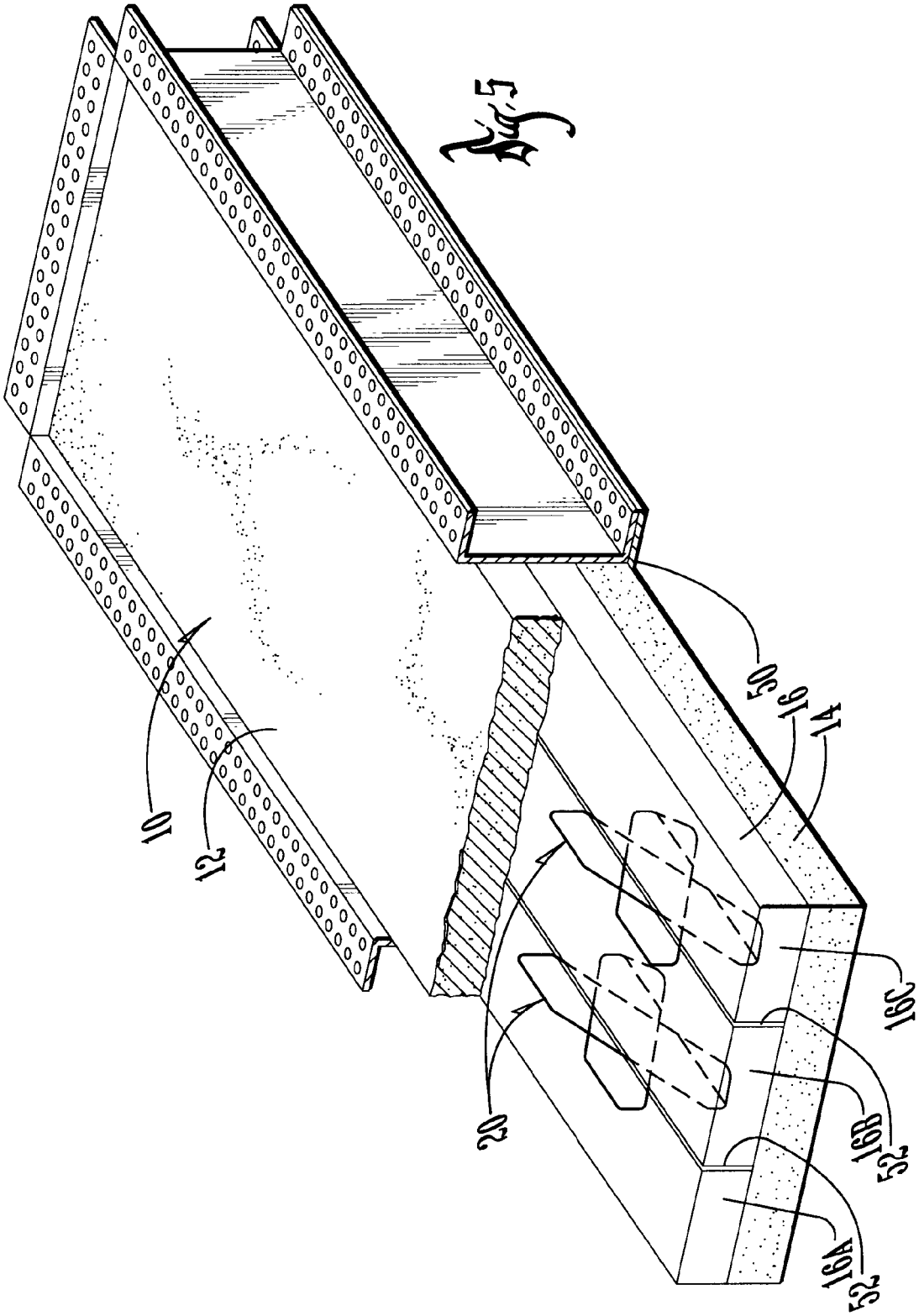
FIG. 5 is a perspective view illustrating the formation of a concrete and insulation sandwich panel utilizing the bow tie connector of this invention.

In order to make a sandwich wall panel 10 using the bow tie connector 20 of the present invention, a form 50 is utilized. See FIG. 5. Preferably one of the concrete wythes 12 or 14, here the bottom wythe 14, is poured in the form 50. Next, strips of insulation material 16A, 16B, 16C, etc. are laid on top of the bottom concrete layer 14. Then the shear connectors 20 are placed or "plunged" into the still plastic concrete layer 14 through the gaps 52 between the insulation strips 16A, 16B, 16C, etc. Care should be taken to make sure that the bottom horizontal strand 24 of the tie connector 20 and the connections of the web 26 thereto are wholly disposed in the bottom concrete layer 14. The "self-chairing" feature of the bow tie facilitates this placement requirement by gauging the depth of strand 24 when the chairing loop or chair leg 32 is in contact with the form 50. The chairing loop 32 rests on the form 50 to positively locate the connector 20. The top concrete layer 12 is then poured on top of the insulation layer 16. Care must again be taken to make sure that the top horizontal strand of the web 26 thereto is wholly disposed in the top concrete layer 12.

Other methods of manufacturing the sandwich wall panel can be used with acceptable results, For example, the tie connectors 20 can be chaired (vertically) and tied (horizontally) in the desired positions by primary and secondary reinforcing strands or other preexisting structures extending across the lower portion of the form 50. Then the concrete for the bottom wythe 14 is poured into the form 50. The insulation strips 16A, 16B, 16C, etc. and the top layer 12 of concrete are then added. Alternately, the connectors 20 can be tied, affixed, or otherwise attached to the side edges of the insulation strips.

While multiple, spaced apart, crossing double loop connectors have been shown in the preferred embodiment, it will understood that single loop configuration will also suffice and one large connector may be substituted for many smaller connectors in the gap(s) between insulation strips.

From the foregoing it can be seen that the present invention is easily incorporated into the manufacture of the sandwich panel 10. The size, shape and number of tie connectors 20 used can be varied to meet the particular load conditions to be encountered. The invention facilitates mass production of sandwich wall panels, which has not heretofore been achieved.

Some of the other advantageous features of the bow tie connector are discussed below.

1. The two loops composing the bow tie connector are manufactured in a continuous winding process, thus eliminating structurally dependent intersections between the angled web and the horizontal chords at the top and bottom. The intersections of the left-angled web main loop and the right-angled web main loop is not a structural intersection in that each loop is designed for tension only and, under load conditions only the left or right loop in transferring tension stresses.

2. The "notched" zones between the left and right main loops of the bow tie connector eliminate conflicts with transverse reinforcing members such as rebar and prestressed strands. Other "truss" type ties have continuous top and bottom horizontal chord elements which interfere with reinforcements pre-placed and post-placed in the concrete wythes during the manufacturing of the sandwiched insulated panels. This conflict often precludes the use of mass production processes for forming the panels.

The notched feature of the bow tie connector allows this shear tie to be placed into the still plastic concrete without "pre-tying" the insert to the reinforcement of the rigid insulation. This facilitates the use of mass production processes for forming the panels.

3. The continuous loop design of the bow tie connector fully imbeds into the concrete wythes and with mild consolidation of the concrete, the full capacity of the insert is fully developed. This concrete-to-insert developments allows the concrete itself to act as the tension/compression chords associated with full truss designs. The compactness of the bow tie connector design allows the concrete to span from one development loop to the other without the need of secondary or primary reinforcements.

4. The load development capacity of the bow tie connector is higher than typical full truss inserts due to the elimination of structural intersections of the web and chords (continuous loop design). The main loops are designed for full tension only. The FRP insert is not matrix dependent, thus the full tension capacity of glass fibers is utilized. The compact design utilizes the compression strength of the concrete as part of the total design.

5. The bow tie connector is self-chairing. The chairing loop below the lower horizontal chord serves to gauge the depth to which the bow tie connector is imbedded into the concrete wythes. The proper gauging of the depth is critical to the design of the sandwiched insulated panel. This chair gauging is critical to facilitating mass production processes for forming the panels. The chair is dimensioned to allow the bow tie connector to be plunged into the plastic concrete until the lower tip of the chairing loop is in contact with the bottom of the concrete form surface. The FRP material will not cause rusting on the surface of the panel.

Therefore, it can be seen that the present invention at least achieves its stated objectives.

The preferred embodiment of the present invention has been set forth in the drawings and specification, and although specific terms are employed, these are used in a generic or descriptive sense only and are not used for purposes of limitation. Changes in the form and proportion of parts as well as in the substitution of equivalents are contemplated as circumstances may suggest or render expedient without departing from the spirit and scope of the invention as further defined in the following claims.

What is claimed is:

1. A concrete and insulation sandwich wall panel, comprising:

a first concrete wythe having an exposed surface;

a second concrete wythe having an exposed surface generally opposite the exposed surface of the first concrete wythe;

an insulative layer interposed between the first and second wythes, the insulative layer having at least one gap therethrough in communication with both the first and second concrete wythes;

a tie shear connector extending through the gap and imbedded into the first and second concrete wythes, the connector being a structural tie shear connector including first and second spaced horizontal strands of thermally non-connective material, the first strand being incased by the first concrete wythe and the second strand being encased by the second concrete wythe;

a web of thermally non-connected material intregally joining the first and second strands through the gap in the insulative layer, the web comprising a continuous main loop, at least one portion of the loop extending at an angle with respect to one of the first and second strands such that the angled portion of the loop is in tension when a load is applied to the sandwich wall panel; and an anchoring loop portion that extends outwardly beyond one of the first and second horizontal strands and into one of the first and second concrete wythes so as to form a continuous closed loop defining a space therewithin filled with concrete to hold the connector in place.

2. The sandwich wall panel of claim 1 wherein the strands and the web are formed of fiberglass reinforced plastic.

3. The sandwich wall panel of claim 1 wherein the strands and the web are a single integrated unit wound together on a mandrel.

4. The sandwich wall panel of claim 1 wherein the first and second strands are substantially parallel with each other.

5. The sandwich wall panel of claim 1 wherein the angled portion of the loop comprises an angled strand which extends at an angle of approximately 30 degrees to 60 degrees with respect to the first horizontal strand.

6. The sandwich wall panel of claim 1 wherein the angled portion of the loop comprises an angled strand which extends at an angle over approximately 50 degrees with respect to the first horizontal strand.

7. The sandwich wall panel of claim 1 wherein the first and second strands and the web reside in a common plane.

8. The sandwich wall panel of claim 1 wherein the web has a chairing loop portion which extends outwardly beyond one of the first and second horizontal strands for the purpose of gauging the placement of the connector relative to an exposed surface of one of the first and second concrete wythes.

9. The sandwich wall panel of claim 8 wherein an enclosed anchoring gap is defined between the loop portion and one of the first and second horizontal strands in a vertical plane, the anchoring gap being large enough to permit wet concrete to flow through the anchoring gap and in case the loop portion so as to hold the device in a desired position when the wet concrete cures.

10. The sandwich wall panel of claim 1 wherein the first and second horizontal strands and the web are formed into a continuous crossing double loop configuration resembling a bow tie.

11. The sandwich wall panel of claim 1 wherein at least one of the first and second strands comprises a plurality of spaced apart sections adapted to receive a generally transverse reinforcing strand in a notch formed therebetween.

12. The sandwich wall panel of claim 1 wherein the notch is V-shaped.

13. The wall panel of claim 1 wherein the anchoring loop portion of the connector has a remote end that is coplanar with the exposed surface of one of the first and second concrete wythes.

* * * * *

UNITED STATES PATENT AND TRADEMARK OFFICE
CERTIFICATE OF CORRECTION

PATENT NO : 6088985
DATED : July 18, 2000
INVENTOR(S) : Timothy L. Clark

It is certified that error appears in the above-identified patent and that said Letters Patent are hereby corrected as shown below:

In column 5, line 25, "understood" should read -- be understood --.

In column 5, line 64, "This" should read -- These --.

In column 5, line 64, "allows" should read -- allow --.

In claim 1, column 6, line 46, "non-connective" should read -- non-conductive --.

In claim 1, column 6, line 52, "non-connective" should read -- non-conductive --.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*

UNITED STATES PATENT AND TRADEMARK OFFICE

CERTIFICATE OF CORRECTION

PATENT NO. : 6,088,985
DATED : July 18, 2000
INVENTOR(S) : Timothy L. Clark

It is certified that error appears in the above-identified patent and that said Letters Patent is hereby corrected as shown below:

Column 6, claim 1,
Line 48, please delete "non-connective" and replace with -- non-conductive --.
Line 51, please delete "non-connected" and replace with -- non-conductive --.

Signed and Sealed this

Thirteenth Day of November, 2001

*Attest:*

Nicholas P. Godici

NICHOLAS P. GODICI
*Acting Director of the United States Patent and Trademark Office*

*Attesting Officer*